United States Patent [19]

Hall, Jr.

[11] 4,291,767

[45] Sep. 29, 1981

[54] METHOD FOR STABILIZING AND HANGING SURFACE CASING

[76] Inventor: Emmitt D. Hall, Jr., P.O. Box 822, Atlanta, Tex. 75551

[21] Appl. No.: 118,922

[22] Filed: Feb. 6, 1980

[51] Int. Cl.[3] ..... E21B 33/14; E21B 41/00

[52] U.S. Cl. ..... 166/290; 166/75 R; 166/93; 166/243

[58] Field of Search ..... 166/290, 285, 286, 287, 166/289, 315, 75 R, 86, 87, 93, 243

[56] References Cited

U.S. PATENT DOCUMENTS

| | | | |
|---|---|---|---|
| 2,239,531 | 4/1941 | Laurie | 166/285 X |
| 2,689,139 | 9/1954 | Jones et al. | 166/75 UX |
| 2,824,757 | 2/1958 | Rhodes | 166/75 UX |
| 3,055,424 | 9/1962 | Allen | 166/285 |
| 3,127,197 | 3/1964 | Kretzschmar | 166/75 X |
| 3,209,829 | 10/1965 | Haeber | 166/75 X |
| 3,561,531 | 8/1969 | Miller | 166/285 |

*Primary Examiner*—Stephen J. Novosad
*Attorney, Agent, or Firm*—Jack W. Hayden

[57] ABSTRACT

Surface casing stabilizer and hanger means includes a downwardly tapered and inwardly inclined annular outer surface and a concentric, contoured inner annular surface. The surface casing hanger and stabilizer engages and supports surface casing in a conductor pipe and connects the surface casing to the conductor pipe. In practicing the method, the conductor pipe is first positioned in the earth's surface and a well bore drilled therethrough to the desired depth for receiving the surface casing, which surface casing is then lowered into the well bore. Cement is then discharged through the surface casing to fill the annulus between the surface casing and the conductor pipe. While the cement is soft and before it hardens, the conductor pipe's upper end is cut off at the desired elevation and the surface casing then elevated to enable the surface casing stabilizer and hanger means to be engaged therearound. The surfacing casing and the stabilizer hanger means thereon are then lowered into the upper end of the conductor pipe so that the annular downwardly tapered outer surface of the stabilizer hanger means and the weight of the surface casing flare or swedge the upper end of the conductor pipe and form a bowl to conform with, receive and seat the stabilizer hanger means which in turn holds the surface casing and connects it and the conductor pipe together so as to transmit drilling vibrations and loads to the earth's surface and thereby inhibit cracking of the surface casing.

7 Claims, 8 Drawing Figures

METHOD FOR STABILIZING AND HANGING SURFACE CASING

SUMMARY OF THE INVENTION

Various types of slip and cooperating bowl assemblies are known and used in oil and gas operations to suspend tubular members in a well bore, however prior to this invention no arrangement has been provided whereby the surface casing may set in a well bore and stabilized to reduce if not completely eliminate cracking thereof or damage thereto. Further no prior method or apparatus employed in setting surface casing enabled subsequent operations, prior to setting of the cement, as does the present method and apparatus.

In the drilling of wells, such as oil and gas wells, it is customary to position what is termed a conductor pipe in the earth's surface which extends downwardly in the earth's surface a suitable distance. The conductor pipe is positioned in the earth by any suitable means such as by a diesel hammer, or drilling a hole and then positioning the conductor pipe therein.

If the conductor pipe has been driven into the earth's surface, it is drilled out by any suitable means and the drilling operations thereafter continued to a desired depth at which it is intended to set the surface casing. Prior to the present invention, the surface casing has been lowered through the conductor pipe and cement then discharged in a manner well known in the art down through the surface casing to fill the annular space between the surface casing and the conductor pipe in an attempt to stabilize the surface casing during subsequent well operations.

Thereafter the surface casing is elevated by mechanical means at the earth's surface to elevate it slightly off the bottom of the hole that has been drilled and in which the cement is positioned to enable the surface casing to straighten itself out. This position is maintained until the cement is hardened to inhibit any cork screwing of the surface casing in the conductor pipe or movement of the surface casing over to one side or the other of the conductor pipe. It can be appreciated that such prior art method requires that further well operations be interrupted and delayed for a period of time to enable the cement to harden, by way of example ten to twelve hours. Even though fast setting cement is used, this procedure has heretofore been employed, thus necessitating an interruption and delay of well operations while the cement hardens. This procedure is extremely time consuming and expensive.

Stabilization of the surface casing, as the term "stabilization" is employed to those skilled in the art, means to attempt to support the surface casing in a manner so that it will withstand well operations, including loads during subsequent well operations, vibrations of the drilling operations as the drill string is lowered and rotated therein during subsequent drilling of the well after the surface casing has been completed, and the like. Such drilling continues of course to the desired depth.

In some instances the surface casing may crack during subsequent well operations and when this occurs, it is necessary to carry out operations to repair it to enable normal drilling operations to be carried out in a manner well known to those skilled in the art.

The problem of the prior art stabilization methods and apparatus has heretofore been further complicated by the fact that the cement in the annular space between the surface casing and conductor pipe, in whole or in part, may be lost due to pressure conditions or formation conditions in the well bore. In such event it is necessary to again inject additional cement as may be required or desired by the owner of the well.

In some instances, aggregate such as crushed rock or gravel is used as the subsequent filler substance where the cement has fallen away during its hardening process. An attempt is made to vibrate or shake the surface casing as the gravel is injected into the annular space between the conductor pipe and the surface casing to attempt to fill all voids in the annular space and thus attempt to further stabilize the surface casing and inhibit cracking thereof or damage thereto during drilling and well operations.

After the cement has hardened, or after additional material such as cement or aggregate is positioned in the annular space, if such addition is necessary, the conductor pipe is then cut off at its upper end, and the surface casing is cut off at its upper end and a braden head or well head is secured to the upper end of the surface casing and a blowout preventer arrangement including one or more blowout preventers then secured to the well head in a manner well known in the art.

The present invention provides a method and apparatus for stabilizing surface casing in the earth's surface in a manner so as to eliminate the above and other problems attendant with the procedure and arrangement presently employed.

In practicing the method of the present invention, the surface casing is positioned in the conductor pipe and cement then discharged in the surface casing to fill the annular space between the conductor pipe and surface casing. The conductor pipe is then cut off at the desired position or elevation in relation to the top of the earth's surface and the surface casing is elevated slightly before the cement hardens. The surface casing stabilizer and hanger means provided with a downwardly tapered annular outer surface and a contoured inner annular surface is positioned around the elevated surface casing immediately above the upper end of the conductor pipe, and the surface casing and stabilizer means then lowered simultaneously into the open upper end of the conductor pipe. The weight of the surface casing and the downwardly and inwardly inclined taper on the outer surface of the stabilizer means causes the upper end of the conductor pipe to flare or swedge outwardly and form a bowl or seat for receiving, holding and seating the stabilizer and hanger means. The stabilizer and hanger means in turn supports the surface casing and connects it to the conductor pipe. Hence the surface casing is thereby supported by the earth. In this manner drilling loads, vibrations and other impacts encountered during drilling or other well operations that are normally transmitted to the surface casing and surrounding concrete are by the present invention transmitted through the stabilizer and hanger means to the conductor pipe and surrounding earth.

This greatly reduces, if not completely eliminates, the likelihood of cracking the surface casing due to vibrations and loads or impacts that arise during drilling and well operations.

The present invention also eliminates the necessity of waiting for the cement to harden before proceeding with well operations, since the stabilizing and hanger means retains the surface casing in position in the conductor pipe so that the upper end of the conductor pipe and the upper end of the surface casing may be immediately cut off and the braden head attached thereto by welding or other suitable means and the blowout preventer arrangement including one or more blowout preventers then secured to the top of the braden head or well head, whereupon other well drilling operations may proceed immediately.

The above may all be accomplished without waiting for the cement to harden and without requiring the surface casing to be held in elevated position by mechanical means, such as elevators, since the stabilizer and hanger means properly supports the surface casing during these operations and while other operations continue as the cement hardens.

In some instances, operators desire to fill the annular space between the surface casing and the conductor pipe with additional material such as cement or aggregate and the like if a loss of cement has occurred in the annular space due to a pressure differential in the formation in the well bore or due to other reasons. The stabilizer and hanger means of the apparatus forming part of the present invention includes openings extending longitudinally therethrough the enable a suitable substance to be injected therethrough whether it is aggregate or whether it is wet cement.

Thus, it can be seen that the present invention substantially reduces the time, rig cost and delay heretofore encountered in positioning surface casing in the earth's surface and provides a novel method and apparatus for stabilizing the surface casing and providing additional support thereto not possible with arrangements heretofore employed.

An object of the present invention is to provide a method for transmitting drilling vibrations and loads from the surface casing to the surrounding earth during well drilling and other operations wherein a conductor pipe is positioned in the earth's surface with the surface casing extending therethrough and cement positioned in the annular space between the conductor pipe and surface casing including the steps of elevating the surface casing before the cement hardens, positioning stabilizing and hanger means with a downwardly tapered annular outer surface and a contoured inner annular surface around the surface casing whereby the inner annular contoured surface engages the surface casing and thereafter lowering the surface casing and stabilizing and hanger means simultaneously into the conductor pipe so that the tapered outer surface and the weight of the surface pipe cooperate to flare the upper end of the conductor pipe to form a bowl for seating the stabilizer and hanger means and thereby securing the surface casing to the conductor pipe and hence the surrounding earth's surface to stabilize the surface casing for well operations.

Another object of the present invention is to provide in an arrangement where a conductor pipe is positioned in the earth's surface with a surface casing cemented in place therein, the invention comprising stabilizer and hanger means preferably in the form of annular ring means extending between and mechanically engaging the surface casing and conductor pipe to secure the surface casing adjacent the upper end of the conductor pipe to thereby transmit vibrations, loads and the like encountered during drilling and other well operations to the surrounding earth and thereby inhibit cracking of the surface casing.

Other objects and advantages of the present invention will become apparent from a consideration of the following description and drawings.

DESCRIPTION OF THE PREFERRED EMBODIMENTS

Figure 4:
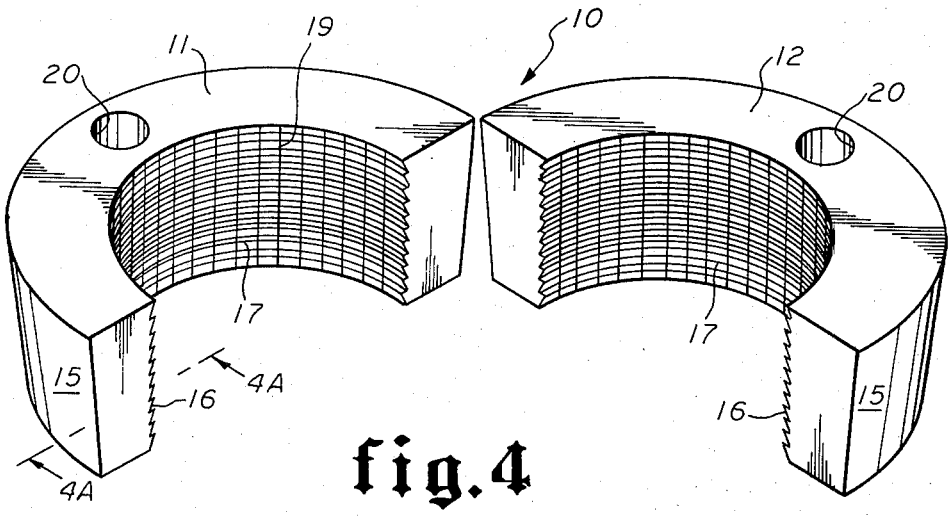
FIG. 4 is a perspective view showing one arrangement of the stabilizer and hanger means of the present invention.

Attention is first directed to FIG. 4 of the drawings wherein a form of the surface casing stabilizer and hanger means of the present invention is referred to generally by the numeral 10. The means 10 is shown as including a pair of annular or arcuate segments 11 and 12 which when positioned together form a ring to engage the surface casing represented by the letter C and the conductor pipe represented by the letter P in FIGS. 1 and 2. Although the means 10 is illustrated in the drawings as comprising two segments, it can be appreciated that any suitable number of annular or arcuate segments may be employed. In some instances it may even be desirable to employ a solid annular member which may be positioned on the surface casing by lowering it therearound.

The outer circumferential surface 15 of the segments 11 and 12 is annular, and is tapered and inclined inwardly and downwardly as illustrated in FIG. 4 of the drawings. The inner circumferential surface 16 of the segments 11 and 12 forming the means 10 extends longitudinally and is provided with a contoured surface as represented at 17 for engaging and gripping or holding the outer surface of the surface casing C. It can be appreciated that the opening formed by the inner annular arcuate surface 16 on the segments 11 and 12 of the gripping means 10 is of suitable size to fit snugly about the surface casing C. Similarly, the width of the segments 11 and 12 will be larger than the annular space A between the surface casing C and conductor pipe P, as shown in the drawings.

Figure 4A:
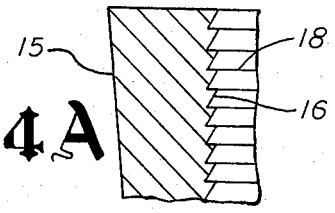
FIG. 4A is a partial sectional view on the line 4—4 of FIG. 3 showing one form of the contoured inner surface on the stabilizer and hanger means.

In FIG. 4A, the outer annular tapered surface 15 is better illustrated as is the inner annular contoured surface 16, and it can be seen that the contour 17 may be formed in any suitable means such as by the circumferentially extending and longitudinally spaced serrations 18 and longitudinally extending grooves 19 formed on the inner surface 16 of each segment to form means for gripping the surface casing C.

Figure 1:
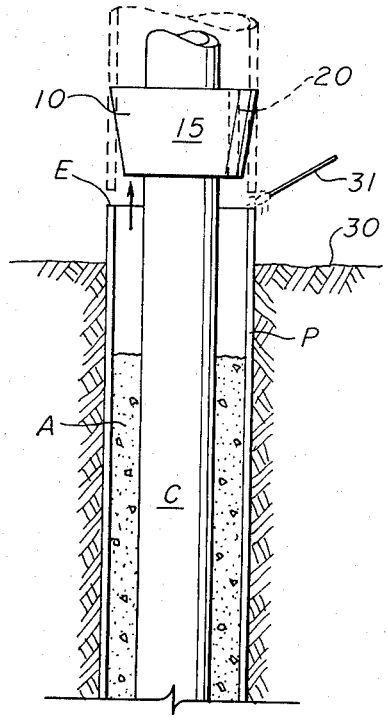
FIG. 1 is a diagrammatic sectional view illustrating the upper portion of the earth's surface with a conductor pipe positioned therein, a surface casing positioned in the conductor pipe and cement positioned in the annular space between the conductor pipe and surface casing. The view also diagrammatically represents the conductor pipe then cut off, and the surface casing elevated with the preferred form of the stabilizer and hanger means of the present invention positioned around the surface casing immediately above the upper end of the conductor pipe.
Figure 3:
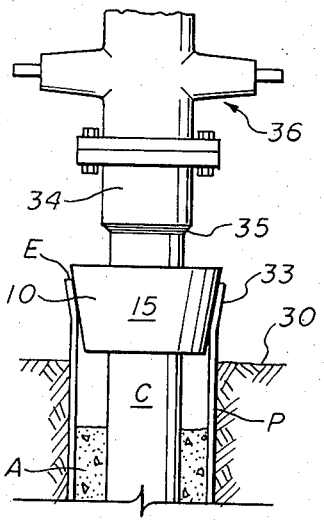
FIG. 3 diagrammatically represents the apparatus after the surface casing has been cut off as schematically illustrated in FIG. 2 by any suitable means such as a cutting torch, and a braden head or well head then secured to the upper end of the surface casing and a blowout preventer stack then secured to the well head.
Figure 2:
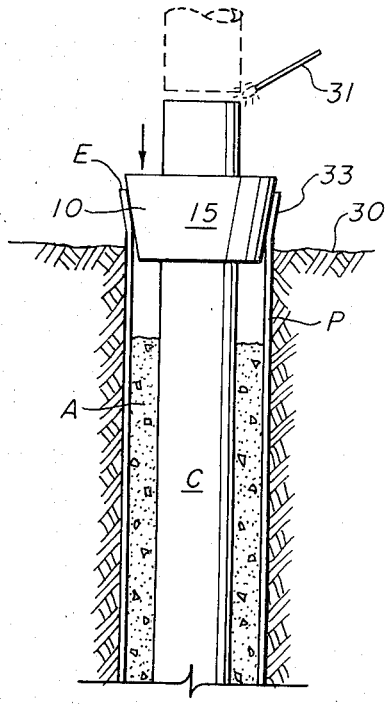
FIG. 2 illustrates the surface casing stabilizer hanger means seated in the upper end of the conductor pipe after the surface casing and stabilizer means have been lowered thereinto to flare the upper end of the conductor pipe and secure the surface casing to the conductor pipe.

If desired, suitable openings as represented at 20 extend longitudinally through the segments 11 and 12 forming the gripping means 10 to provide access to the annular space represented at A in FIGS. 1 and 2 between the surface casing C and conductor pipe P after the means 10 and surface casing have been seated in positioned in the conductor pipe P as illustrated in FIG. 2 of the drawings.

Figure 5:
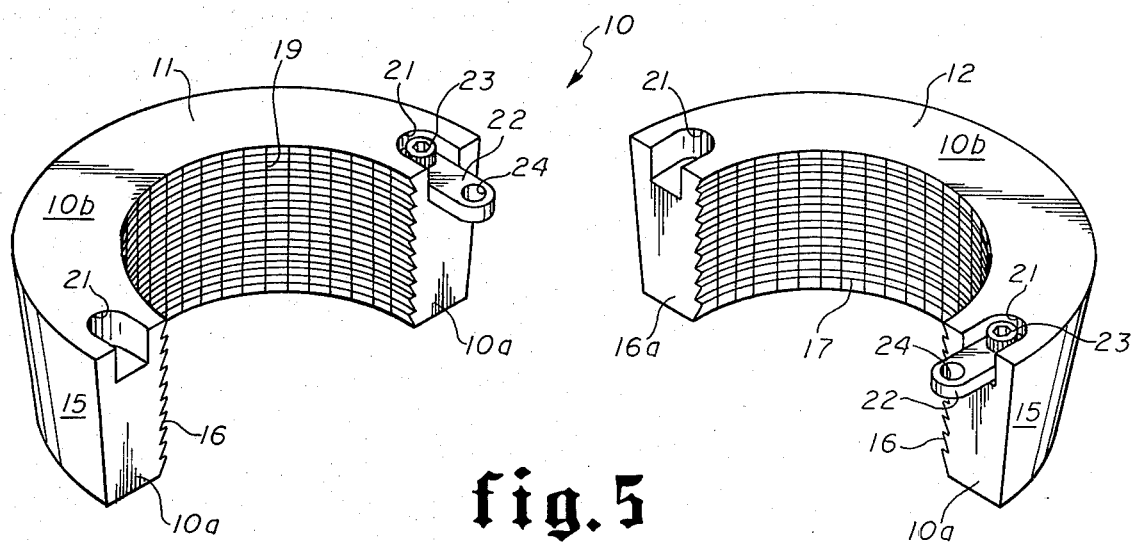
FIG. 5 illustrates an alternate form of the surface casing stabilizer and hanger means in the form of annular segments having means associated therewith for securing the annular segments in end to end relation to form a ring.

In FIG. 5 the means 10 is again illustrated as being in the form of two semi-circular arcuate segments of the same general configuration as shown in FIG. 4. However, in this arrangement suitable means are provided for securing the segments together around the surface casing which may be desirable if the size of the segments is bulky, or if only one person is attempting to employ and practice the present invention. The connecting means may be of any suitable form and as illustrated may be formed by a notch 21 adjacent each end 10*a* and in the top surface 10*b* of each of the arcuate segments 11 and 12. A link member 22 is connected at one end by a screw 23 into one notch 21 in each of the segments 11 and 12 as shown. The link 22 projects beyond the end 10*a* of its respective segment 11 and 12 and is provided with an opening 24 adjacent the other end as shown in FIG. 5.

The end of the link 22 with the opening 24 is then positioned in the recess 21 opposed thereto when the ends 10*a* of the segments 11 and 12 are abutted. Thereafter a suitable screw is positioned through the opening 24 and into a threaded opening (not shown) in the receiving recess to secure the segments 11 and 12 together to form an annular ring.

Where the conductor pipe is of substantial diameter, it can be appreciated that the segments 11 and 12 may become quite bulky and heavy. In this event, the segments may be formed so that the outer body or shell portion 25 is formed of aluminum or bronze and has the same general configuration as that previously described including an outer annular downwardly tapered surface 15. In the form of the invention illustrated in FIG. 7 the inner surface 16 is formed in part by the inwardly extending portion 16*a* at the bottom of the segments to receive and support the removable insert or inserts 16*b* which provide the contour or gripping surface 17. They may be shaped as generally shown and retained in position on the body portion 25 by suitable means such as the screws 26, which extend through cover plates, inserts 16*b*, and engage in threaded openings (not shown) in body 25. The inserts 16*b* may be replaced as desirable or necessary. It can be appreciated that the portions 16*b* may be formed of steel or other material to grip and hold the surface casing C.

Figure 6:
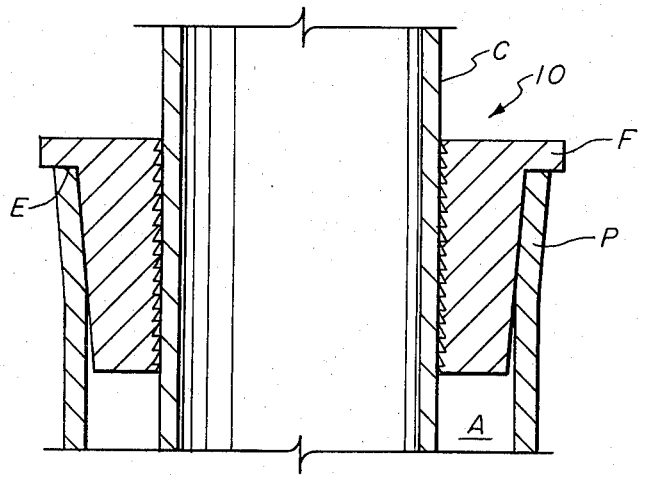
FIG. 6 illustrates yet another alternate form of the stabilizer means with an annular lip thereon for engaging and seating on the upper end of the conductor pipe.

Further, in those instances where the size and arrangement or the spacing between the surface casing C and pipe P may tend to cause the splitting of the conductor pipe or may cause improper seating of the stabilizing means 10, the arrangement illustrated in FIG. 6 may be employed wherein the means 10 is provided with a laterally and annularly extending flange F adjacent the upper end of such means for engaging and seating on the upper end E of the conductor pipe P. This will limit the travel of the means 10 and tend to eliminate splitting of the conductor pipe P where substantial loads are encountered or where the annular space A between the surface casing C and conductor pipe P is substantial. It also tends to eliminate movement of the gripping means 10 on through the conductor pipe P along with the surface casing C in those instances where such action might otherwise occur.

In practicing the method of the present invention, conductor pipe P is first positioned in the earth's surface as represented at 30 by any suitable means such as by a diesel hammer, or by any other suitable means. The conductor pipe P is extended into the earth's surface a desired distance and thereafter the earth is drilled out from the conductor pipe, if the conductor pipe has been driven into the earth's surface, and drilling operations then continue down to a depth at which it is desired to set the surface casing C. Thereupon the surface casing C is lowered by the drilling apparatus at the top 30 of the earth's surface and cement then discharged or pumped down through the surface casing C in a manner well known in the art and upwardly around the surface casing C in the interior of the conductor pipe P until the annular space referred to by the letter A is filled.

Thereafter, the conductor pipe P is cut off by any suitable means such as by a cutting torch represented at 31 in FIG. 1 whereby the upper end E of the conductor pipe is positioned relative to the earth's surface as desired.

Also, before the cement in the annular space A hardens, the surface casing C is elevated slightly, say six to ten inches, and the means 10 then positioned therearound, whereupon the surface casing C and the stabilizing means 10 may be simultaneously lowered into the open upper end E of the conductor pipe P. Since the outer surface 15 of the means 10 is tapered downwardly and inclined inwardly as shown in the drawings, the weight of the surface casing C and downwardly extending taper on the outer surface 15 cooperate to cause the upper end E of the conductor pipe P to swedge or flare outwardly as represented at 33 in FIG. 2 of the drawings. The flaring of the conductor pipe P forms a bowl or seat for receiving, supporting and seating the means 10. Thus the means 10 is seated adjacent the upper end E of the conductor pipe P and the resultant inward pressure on the annular inner surface 16 and the contoured surface 17 thereon causes the surface casing C to be gripped and supported by such means 10.

Thereafter, the surface casing C may be cut off by any suitable means such as by a cutting torch as diagrammatically represented at 31 in FIG. 2 and a braden head, or well head, as represented at 34 secured by any suitable means such as a weld 35 to the upper end of the surface casing C and a blowout preventer diagrammatically represented at 36 then secured to the braden head or well head 34 by any means well known in the art.

If, after hardening of the cement it is determined that the level of the cement has fallen substantially, some well operators or owners may desire that additional substance be placed in the annulus A to assist in stabilization of the surface casing C. In such instances, the substance may be discharged through the openings 20 of the segments 11 and 12 and into the annular space A, whether the substance is cement or aggregate.

At any event, it can be appreciated that the method of the present invention enables the conductor pipe P to be cut off without waiting for the cement in the annular space to harden and also enables the surface casing C to be anchored to the conductor pipe P and retained in proper position while the cement hardens so as to tend to eliminate any cork screwing of the surface casing C and thereby properly positioning it within the conductor pipe P.

Further the surface casing C may be cut off as above described and the braden head 34 and blowout preventer arrangement 36 are secured in positioned thereon also without waiting for the cement to harden.

This procedure saves substantial time and money and enables drilling operations to proceed without substantial interruption.

Further, by anchoring the surface casing C adjacent the upper end of the conductor pipe P, drilling vibrations and loads as well as other loads and vibrations imparted to the surface casing C during drilling and completion of the well are transmitted through the stabilizing and hanger means 10 to the conductor pipe P and the surrounding earth.

This greatly reduces, if not substantially eliminates the possibility or probability of surface casing C cracking during drilling or other well operations which has been heretofore encountered in the procedure where only cement is used in the annular space to attempt to stabilize the surface casing C, or where other substance such as aggregate, or additional cement is placed in the annulus A if the cement falls in the annular space A during hardening.

In addition to the substantial savings in time and elimination of delay and costly rig time, the gripping means or surface casing stabilizer hanger 10 appears to provide substantial advantage in stabilizing the surface casing C and supporting it not only during hardening of the cement while other operations at the earth's surface may be carried out to enable additional drilling operations to be continued, but it also provides stabilization throughout subsequent drilling and well operations and transmits vibrations and loads to the surrounding earth's surface thus inhibiting cracking of the cement in the annular space or cracking of the surface casing which might otherwise occur with prior arrangements and methods.

Figure 7:
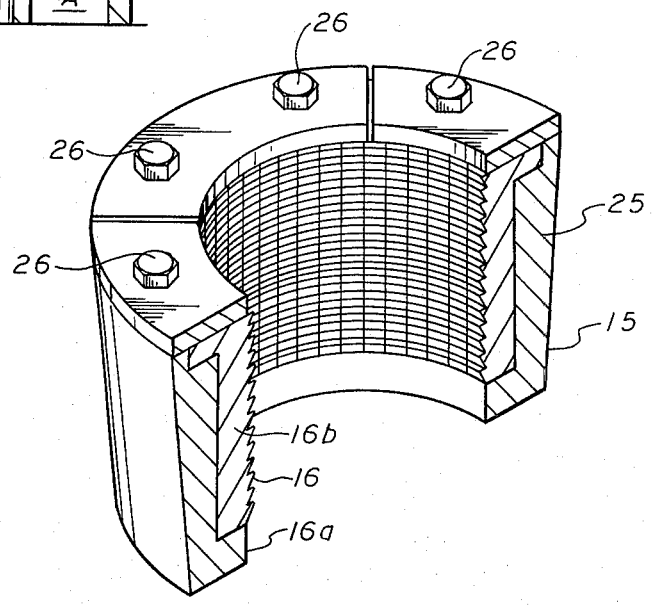
FIG. 7 illustrates yet another alternate form of the stabilizer means.

In those situations where the size of the conductor pipe P and surface casing C are both relatively large so that there is a substantial annular space A, it may be desirable to provide the form of the surface casing stabilizing means 10 as illustrated either in FIGS. 6 or 7. It can be appreciated that where the annular space A is relatively large, the weight and general configuration of the casing stabilizer hanger 10 may be such that it will be difficult for one or two people to position it in place. In this event, the form shown in FIG. 7 may be employed wherein the outer body 25 is formed of a lighter material such as aluminum, bronze or the like and is provided with removable inserts which are formed of harder material and have serrations or is provided with a contoured surface 17 for gripping the surface casing.

Further in those instances where the weight of the surface casing stabilizer hanger 10 and the size of the annulus A along with the weight of the surface casing C is such that there may be a tendency to split the conductor pipe P, or is such that there may be a tendency for the surface casing stabilizer hanger 10 to move on through or down into the conductor pipe P so as to not properly position the surface casing C, the surface casing stabilizer hanger 10 may be provided with an annular lip or projection as reflected at F to engage and seat on the upper end E of the conductor pipe P and thus prevent undesired continued movement of the surface casing C and stabilizing hanger or gripping means 10 relative to the conductor pipe P.

The foregoing disclosure and description of the invention are illustrative and explanatory thereof, and various changes in the size, shape, and materials as well as in the details of the illustrated construction may be made without departing from the spirit of the invention.

What is claimed is:

1. A method of stabilizing surface casing in the earth's surface for well operations comprising the steps of:

a. positioning conductor pipe in the earth's surface;

b. lowering surface casing through the conductor pipe;

c. positioning cement between the conductor pipe and the surface casing;

d. elevating the surface pipe before the cement hardens;

e. positioning stabilizer and hanger means with a downwardly tapered annular outer surface and a serrated inner annular surface around the surface casing whereby the serrated inner surface engages the surface casing; and f. lowering the surface casing and stabilizer and hanger means thereon into the conductor pipe whereby the tapered outer surface and the weight of the surface pipe flare the upper end of the conductor pipe to form a bowl for receiving, seating and supporting the stabilizer and hanger means to thereby secure the surface casing to the conductor pipe and hence the surrounding earth's surface to stabilize the surface casing for well operations.

2. The method of claim 1 including the step of cutting off the conductor pipe after the cement is positioned and before elevating the surface casing.

3. In a method of stabilizing surface casing for well drilling operations therethrough in the earth's surface wherein conductor pipe is positioned in the earth's surface, the surface casing then lowered in the conductor pipe and cement positioned between the conductor pipe and surface casing, the steps comprising:

a. elevating the surface pipe before the cement hardens;

b. positioning stabilizer and hanger means with a downwardly tapered annular outer surface and gripping means formed by a serrated inner annular surface around the surface casing whereby the serrated inner surface engages the surface casing; and c. lowering the surface pipe and gripping means thereon into the conductor pipe whereby the tapered outer surface and the weight of the surface pipe flare the upper end of the conductor pipe to form a bowl for receiving, seating and supporting the stabilizer and hanger means to thereby secure the surface casing to the conductor pipe and hence the surrounding earth's surface to stabilize the surface casing for well operations.

4. The method of claim 3 including the additional steps of:

a. cutting off the surface casing before the cement hardens;

b. securing a well head to the surface casing before the cement hardens; and c. securing a blowout preventer arrangement on the well head before the cement hardens.

5. A method for transmitting drilling vibration and loads from the surface casing to the surrounding earth during well drilling operations wherein a conductor pipe is positioned in the earth's surface with the surface casing extending therethrough and cement is positioned between the conductor pipe and surface casing, the steps comprising:

a. elevating the surface pipe before the cement hardens;

b. positioning stabilizer and hanger means with a downwardly tapered annular outer surface and a serrated inner annular surface around the surface casing whereby the serrated inner surface engages the surface casing; and c. lowering the surface casing and stabilizer and hanger means thereon into the conductor pipe whereby the tapered outer surface and the weight of the surface pipe flare the upper end of the conductor pipe to form a bowl for receiving, seating and supporting stabilizer and hanger means to thereby secure the surface casing to the conductor pipe and hence the surrounding earth's surface to stabilize the surface casing for well operations.

6. The method of claims 1 or 2 or 3, or 5 including the additional step of thereafter positioning additional material between the conductor pipe and the surface casing.

7. The method of claim 6 wherein the additional material positioned between the conductor pipe and the surface casing is aggregate.

* * * * *